US005165136A

United States Patent [19]

Moore

[11] Patent Number: 5,165,136

[45] Date of Patent: Nov. 24, 1992

[54] DUST MOP HEAD

[76] Inventor: Terry D. Moore, 2415 Hinton Rd., Dacula, Ga. 30211

[21] Appl. No.: 827,744

[22] Filed: Jan. 29, 1992

Related U.S. Application Data

[63] Continuation-in-part of Ser. No. 641,285, Jan. 15, 1991.

[51] Int. Cl.[5] ..... A47K 7/02; A47L 1/06

[52] U.S. Cl. ..... 15/229.4; 15/229.8

[58] Field of Search ..... 15/229.3, 229.4, 229.7, 15/229.8

[56] References Cited

U.S. PATENT DOCUMENTS

| | | | |
|---|---|---|---|
| 1,520,148 | 12/1924 | Schickluna | 15/229.8 |
| 2,929,087 | 3/1960 | Salmon | 15/229.8 |
| 3,128,127 | 4/1964 | O'Connor et al. | 15/229.8 X |
| 3,991,432 | 11/1976 | Griffin et al. | 15/229.8 |
| 4,715,081 | 12/1987 | Welch | 15/229.8 |
| 4,914,778 | 4/1990 | Thompson | 15/229.8 X |

FOREIGN PATENT DOCUMENTS

| | | | |
|---|---|---|---|
| 0599029 | 10/1925 | France | 15/229.8 |
| 395662 | 7/1933 | United Kingdom | 15/229.8 |

*Primary Examiner*—Paul T. Sewell
*Assistant Examiner*—Beth Anne C. Cicconi
*Attorney, Agent, or Firm*—James B. Middleton

[57] ABSTRACT

A mop head for use on a dust mop frame with bumpers includes opposed pockets for receiving opposite ends of the mop frame, and sides of the pockets are selectively openable and closable. The pockets can therefore be opened along the sides, so the mop frame with the bumper can be inserted into the pocket, and the pocket closed. Projections from the mop frame for connecting the bumper to the frame extend out next to the flap that closes the opening. The preferred form of mop head includes openings for both opposed pockets to accommodate a mop frame having bumpers on both ends.

6 Claims, 1 Drawing Sheet

Fig_1
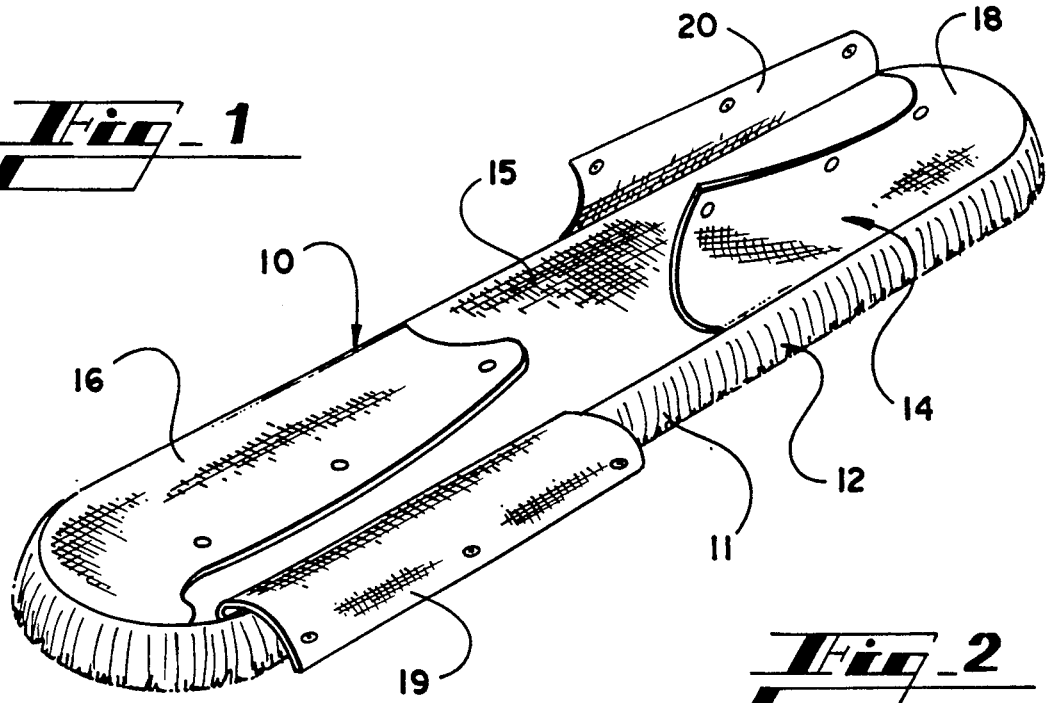
Fig_2
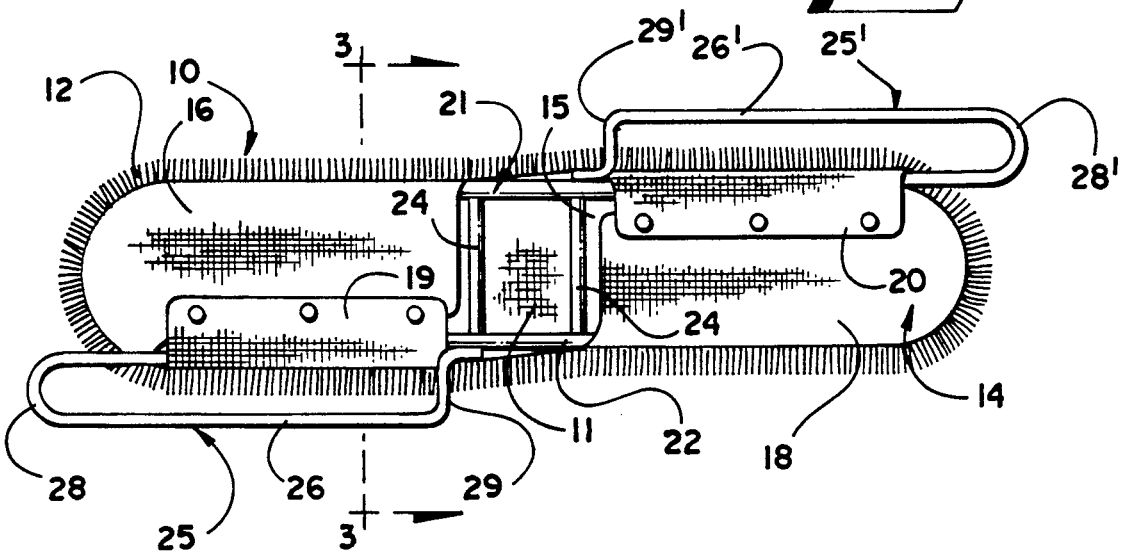
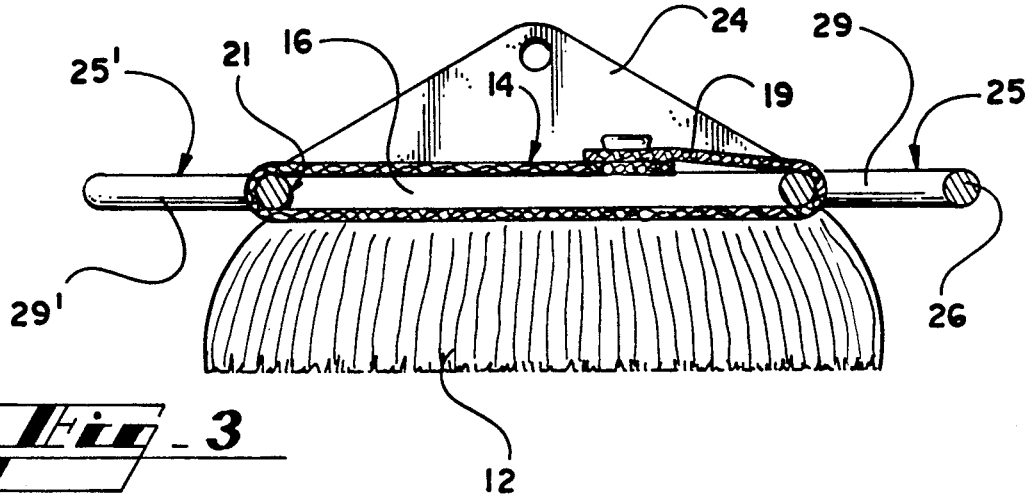
Fig_3

DUST MOP HEAD

CROSS-REFERENCE TO RELATED APPLICATION

This application is a continuation in part of the co-pending application of the same inventor titled "Dust Mop with Bumper", filed Jan. 15, 1991, and having Ser. No. 641,285.

INFORMATION DISCLOSURE STATEMENT

The basic dust mop is old and well known in the art, and has been used successfully for many years. More recently, conventional dust mops have been mounted on industrial trucks to be moved through a warehouse or the like. The mounting on industrial trucks is very beneficial in that the well-known and effective dust mops are used at high speed to sweep and dust a large floor in a short period of time.

In using the dust mops mounted on industrial trucks, the mops periodically engage solid obstacles. The above identified co-pending application discloses a mop with a bumper thereon so arranged that the bumper engages the solid obstacles and protects the mop head. The bumper therefore protects the mop head from excessive wear and extends the useful life.

While the mop head disclosed in the co-pending application is effective, the number of flaps and fasteners is such that changing of mop heads is slow, which reduces efficiency in cleaning floors.

SUMMARY OF THE INVENTION

This invention relates generally to dust mops, and is more particularly concerned with a dust mop head easily receivable on a mop frame having a bumper thereon.

The present invention provides a mop head having a pocket on each end of the mop head for receiving each end of a mop frame. Each of the pockets is openable along a side, and fastening means are provided for selectively closing the pockets. The flaps used to close the pockets are preferably located at bumpers on the mop frame, the arrangement being such that the flaps pass between the bumper and the mop frame, and provide openings to receive the means for attaching the bumper to the mop frame.

In the preferred embodiment of the invention, a mop head has opposed pockets with an opening between the pockets. One pocket has the flap for closing the pocket on the leading edge of the mop head, and the opposite pocket has the flap on the trailing edge. With this arrangement, the mop is reversible by rotating the mop about its central axis, and a new mop edge, with a bumper, will become the leading edge of the mop.

BRIEF DESCRIPTION OF THE DRAWINGS

These and other features and advantages of the present invention will become apparent from consideration of the following specification when taken in conjunction with the accompanying drawings in which:

FIG. 1 is a perspective view of a mop head made in accordance with the present invention;

FIG. 2 is a top plan view of the mop head shown in FIG. 1, with a mop frame inserted thereinto; and, FIG. 3 is an enlarged, cross-sectional view taken substantially along the line 3—3 in FIG. 2.

DETAILED DESCRIPTION OF THE EMBODIMENT

Referring now more particularly to the drawings, and to that embodiment of the invention here shown by way of illustration, the mop head 10 shown in FIG. 1 of the drawings comprises a base member 11 having a plurality of yarns or strings 12 sewn therein. The base member 11 with the strings 12 makes up the working portion of the mop head, in that this is the portion that contacts a floor and effects the sweeping and dusting. A top member generally designated at 14 holds the base member 11 to a mop frame.

As will be discussed more fully hereinafter, the mop head 10 will be received over a mop frame, and the mop frame will be fixed to a support arm. To allow for this construction, the top member 14 defines a central opening 15, so the top member 14 comprises a pair of pockets 16 and 18, one pocket being at each end of the mop head 10.

The mop head described thus far is conventional, and well known in the art. The unique aspect of the present invention, then, is in the construction of the two pockets 16 and 18. In the prior art mop heads, the most common arrangement is to have one pocket that is completely closed except for an opening at the central opening 15. One end of a mop frame can therefore be inserted into this one pocket. The other pocket is then open, with laces or the like for selectively closing the second pocket. The full opening is necessary in order to place the second end of the mop frame into the second pocket.

In the above identified co-pending application, the two pockets comprise three flaps: two opposed side flaps and an end flap for each pocket. One of the opposed side flaps for each pocket can pass between the mop frame and the bumper.

In the present invention, each of the pockets 16 and 18 includes a single, selectively openable flap, such as the flaps 19 and 20. As a result, most of the pockets 16 and 18 are in place for receiving a mop frame. The one flap 19 or 20 can be opened to allow the mop frame to be slipped into the pocket; and, after the mop frame is within the pocket, the flap can be closed.

The mop head of the present invention can of course be used on conventional mop frames, but the primary purpose of the present mop head is for use on a mop frame having at least one bumper thereon, as disclosed in the above identified co-pending application, and as shown in FIG. 2 of the drawings.

In FIG. 2, the mop head of FIG. 1 is shown installed on a mop frame having bumpers. The mop frame is generally indicated at 21 and includes a central portion 22 having upstanding flanges 24 as mounting means. The frame 21 extends in opposite directions from the central portion 22, and each end carries a bumper, such as the bumper 25. There is also a bumper on the opposite end of the frame 21; but, the two ends are constructed alike, so only one end will be described in detail, and the primes of the same numerals will be applied to corresponding parts.

The frame 21 and the bumper 25 are described in detail in the above identified application, and that application is incorporated herein by reference. Thus, only a brief description will be given.

The bumper 25 includes a front member 26 generally parallel to the frame 21. The outside end of the bumper 25, which is the end away from the central portion 22 of the mop frame 21, includes a loop 28 that is fixed to the frame 21. The inside end of the bumper 25 includes a short leg 29 that is fixed to the frame 21. With this construction, it will be understood that an opening remains between the front member 26 of the bumper 25 and the frame 21. The flap 19 is shown passing through the opening.

Because the present mop head is designed to fit a mop frame with bumpers, there is a small gap between the flap 19 and the rest of the top 14 of the mop head. This gap allows the looped end 28 of the bumper 25 to protrude, so the mop head fits well. The center opening 15 of the mop head provides space for the short leg 29 to extend out to the front member 26.

With the foregoing description in mind, operation of the mop head of the present invention should be understood. When a mop head 10 is to be placed on a mop frame 21, the two flaps 19 and 20 will be opened, and the pocket 16 (for example) can be slipped over one end of the frame 21. A sideways, sliding motion can be used so the mop frame 21 passes through the side opening in the pocket 16. Next, the opposite pocket 18 will be similarly urged onto the opposite end of the frame 21. It will be noticed that the openings at the flaps 19 and 20 do not extend completely to the ends of the pockets. It will be understood, however, that the mop head will stretch enough to be received over the mop frame 21, and the mop head 10 will easily remain in place.

After the mop head 10 is in place on the mop frame 21, the flaps 19 and 20 will be passed through the openings between the front member 26, 26' as shown in FIG. 3, and the snaps or other fastening means secured to hold the flaps in place. The mop head is then fully installed.

It will of course be understood by those skilled in the art that the particular embodiment of the invention here shown is by way of illustration only, and is meant to be in no way restrictive; therefore, numerous changes and modifications may be made, and the full use of equivalents resorted to, without departing from the spirit or scope of the invention as outlined in the appended claims.

I claim:

1. A mop head in the combination with a mop frame for providing a dust mop, said dust mop comprising a laterally elongated mop frame and a mop head received on said mop frame, said mop frame including a center section for selectively fixing said mop frame to mop carrying means, a first lateral end of said mop frame extending laterally from said center section in a first direction and a second lateral end extending laterally from said center section in a second direction which is opposite from said first direction, said mop frame further including a leading edge and a trailing edge extending across said mop frame from said first lateral end, across said center section, and across said second lateral end, said mop head including an elongated base member and a top fixed to said base member and defining pockets between said top and said base member, said pockets including a first pocket on one side of said center section for receiving said first lateral end of said elongated mop frame, and a second pocket on the opposite side of said center section for receiving said second lateral end of said mop frame, said mop head including a first flap for selectively opening and closing an edge of said first pocket, said edge of said first pocket extending along said leading edge of said mop frame, the arrangement being such that one of said lateral edges of said mop frame can be inserted into said first pocket through said edge of said first pocket, and including a fastening means for selectively fixing said flap to said top for closing said edge of said first pocket, and a second flap for selectively opening and closing an edge of said second pocket, said edge of said second pocket extending along said trailing edge of said mop frame, and including a second fastening means for selectively fixing said second flap to said top for closing said edge of said second pocket.

2. The combination claimed in claim 1, said mop frame including a bumper fixed to said mop frame on one end of said lateral ends, said bumper being carried by and adjacent to said leading edge of said mop frame, said bumper including a front member spaced from said one end and disposed forward of said leading edge, and means for fixing said bumper to said frame, said first flap having a width to pass between said means for fixing said bumper to said frame.

3. The combination claimed in claim 2, and further including a second bumper on the other end of said lateral ends, said second bumper being carried by and adjacent to said trailing edge of said mop frame, said second bumper including a member spaced from said other end and disposed rearward of said trailing edge, and means for fixing said second bumper to said frame, said second flap having a width to pass between said means for fixing said second bumper to said frame.

4. A method for installing a dust mop head on a dust mop frame, wherein said dust mop frame includes a center section, a first end extending a first direction laterally from said center section and a second end extending in a second direction, which is opposite from said first direction, laterally from said center section, and said mop head includes a first pocket for receiving said first end and a second pocket for receiving said second end, said mop head having a leading edge and a trailing edge, said method including the steps of opening said first pocket adjacent to said leading edge and opening said second pocket adjacent to said trailing edge, inserting said first end of said frame into said first pocket through the opening in said first pocket adjacent to said leading edge and inserting said second end of said frame into said second pocket through the opening in said second pocket adjacent to said trailing edge, and closing the opening in said first pocket, and closing the opening in said second pocket.

5. The method as claimed in claim 4, wherein said dust mop frame includes at least one bumper carried on said mop frame adjacent to said leading edge of said mop frame, and wherein the said step of closing the opening in said first pocket includes the step of passing a flap between the said bumper and the said mop frame, and subsequently fixing said flap to said mop head.

6. The method as claimed in claim 5, wherein said at least one bumper comprises two bumpers, a second bumper being carried on said mop frame adjacent to said trailing edge of said mop frame, and wherein the said step of closing the opening in said second pocket includes the step of passing a flap between the said second bumper and the said mop frame, and subsequently fixing said second flap to said mop head.

* * * * *